US011591954B2

(12) United States Patent
More

(10) Patent No.: US 11,591,954 B2
(45) Date of Patent: Feb. 28, 2023

(54) ENCLOSURE SEGMENTS FOR FORMING AN ENCLOSURE FOR AN ENGINE GENERATOR SET

(71) Applicant: Cummins Power Generation Inc., Minneapolis, MN (US)

(72) Inventor: Shashikant Ramdas More, Coon Rapids, MN (US)

(73) Assignee: Cummins Power Generation Inc., Minneapolis, MN (US)

( * ) Notice: Subject to any disclaimer, the term of this patent is extended or adjusted under 35 U.S.C. 154(b) by 66 days.

(21) Appl. No.: 17/360,298

(22) Filed: Jun. 28, 2021

(65) Prior Publication Data

US 2021/0404378 A1 Dec. 30, 2021

Related U.S. Application Data

(60) Provisional application No. 63/045,556, filed on Jun. 29, 2020.

(51) Int. Cl.

| | |
|---|---|
| ***F02B 63/04*** | (2006.01) |
| ***F01P 1/06*** | (2006.01) |
| *F01P 1/00* | (2006.01) |

(52) U.S. Cl.

CPC ..... *F02B 63/044* (2013.01); *F01P 1/06* (2013.01); *F01P 2001/005* (2013.01); *F02B 2063/045* (2013.01)

(58) Field of Classification Search

CPC ..... F02B 63/044; F01P 1/06

See application file for complete search history.

(56) References Cited

U.S. PATENT DOCUMENTS

| | | | |
|---|---|---|---|
| 6,833,995 | B1 | 12/2004 | Hsue et al. |
| 6,868,938 | B2 | 3/2005 | Lecours |
| 8,534,198 | B2 | 9/2013 | Matthys |
| 8,672,089 | B2 | 3/2014 | Kelly et al. |

(Continued)

FOREIGN PATENT DOCUMENTS

| | | | |
|---|---|---|---|
| EP | 0 366 195 | A1 | 5/1990 |
| EP | 3 330 447 | A1 | 6/2018 |
| WO | WO-2019/075293 | A1 | 4/2019 |

OTHER PUBLICATIONS

International Search Report and Written Opinion on International Application No. PCT/US2021/039365, dated Oct. 13, 2021, 12 pages.

*Primary Examiner* — Long T Tran

(74) *Attorney, Agent, or Firm* — Foley & Lardner LLP

(57) ABSTRACT

A genset enclosure includes a frame system, a plurality of side panels, a plurality of roof panels, a first connector, and a second connector. The frame system includes a plurality of interconnected frame members. The plurality of side panels are coupled to opposing sides of the frame system. The plurality of roof panels are coupled to a roof of the frame system and extend between the opposing sides of the frame system. The plurality of roof panels are oriented perpendicular to the plurality of side panels. The frame system, the plurality of side panels, and the plurality of roof panels together define an enclosure portion having a first open end and a second open end. The first connector and second connector are engageable with one another and are coupled to the frame system along a perimeter of the first open end and the second open end, respectively.

20 Claims, 11 Drawing Sheets

(56) References Cited

U.S. PATENT DOCUMENTS

| | | | | |
|---|---|---|---|---|
| 10,193,112 | B2 | 1/2019 | Zimbru et al. | |
| 10,371,039 | B2 | 8/2019 | Jochman | |
| 10,485,120 | B1 | 11/2019 | Adams et al. | |
| 10,492,332 | B2 | 11/2019 | Hendrix et al. | |
| 10,876,471 | B2 | 12/2020 | Goleczka et al. | |
| 2008/0185048 | A1 | 8/2008 | Mellon et al. | |
| 2016/0017609 | A1 | 1/2016 | Bottin | |
| 2016/0233739 | A1* | 8/2016 | Jenison | H02K 7/1815 |
| 2017/0201077 | A1* | 7/2017 | Hafner | H04W 84/12 |
| 2018/0354712 | A1* | 12/2018 | Goleczka | H02K 7/1815 |
| 2019/0120134 | A1* | 4/2019 | Goleczka | F02B 63/044 |
| 2019/0338701 | A1* | 11/2019 | Sarder | F02B 63/042 |
| 2020/0240675 | A1* | 7/2020 | Brandt | F24F 11/74 |
| 2021/0108562 | A1* | 4/2021 | Siebert | F02B 63/044 |

* cited by examiner

ENCLOSURE SEGMENTS FOR FORMING AN ENCLOSURE FOR AN ENGINE GENERATOR SET

CROSS-REFERENCE TO RELATED PATENT APPLICATIONS

This application claims the benefit of and priority to U.S. Provisional Patent Application No. 63/045,556, filed Jun. 29, 2020, which is incorporated herein by reference in its entirety.

TECHNICAL FIELD

The present disclosure relates generally to enclosures for housing engines and generators.

BACKGROUND

Generator sets (also known as "gensets") may be employed for physical power production in a variety of applications (e.g., standby/backup power applications, etc.). A genset typically includes an engine and an electric power generator coupled to the engine. The engine is structured to mechanically drive the generator which, in turn, can produce electricity. The engine and the generator may be housed within an enclosure that allows the genset to operate outdoors, and to tolerate environmental extremes of temperature, humidity, precipitation (e.g., rain, snow, ice, etc.), and other factors. In some instances, the enclosures are made from intermodal containers (e.g., ISO containers, cargo containers, shipping containers, etc.) that are sized to contain the entire genset and any auxiliary equipment that is needed to operate the genset (e.g., cooling equipment, etc.). Because of the limited availability of different container sizes, the footprint of the entire genset system is typically larger than required. Additionally, the intermodal containers cannot be easily modified to accommodate different cooling systems or auxiliary equipment that may be used with the genset.

SUMMARY

One embodiment of the present disclosure relates to a genset enclosure. The genset enclosure includes a frame system, a plurality of side panels, a plurality of roof panels, a first connector, and a second connector. The frame system includes a plurality of interconnected frame members. The plurality of side panels are coupled to opposing sides of the frame system. The plurality of roof panels are coupled to a roof of the frame system and extend between the opposing sides of the frame system. The plurality of roof panels are oriented perpendicular to the plurality of side panels. The frame system, the plurality of side panels, and the plurality of roof panels together define an enclosure portion having a first open end and a second open end. The first connector is coupled to the frame system along a perimeter of the first open end. The second connector is coupled to the frame system along a perimeter of the second open end. The second connector is engageable with the first connector.

In some embodiments, the frame system, the plurality of side panels, and the plurality of roof panels together form a first enclosure segment. The genset enclosure may further include a second enclosure segment coupled to the first enclosure segment and engaged with the first connector. The second enclosure segment may extend along an axial direction of the enclosure portion.

In some embodiments, the first connector is one of a plurality of first connectors disposed along the perimeter of the first open end and the second connector is one of a plurality of second connectors disposed along the perimeter of the second open end. Each of the plurality of second connectors may be axially aligned with a respective one of the plurality of first connectors.

In some embodiments, the first connector includes a pin extending axially away from the first open end. The second connector may include an opening dimensioned to receive the pin therein.

In some embodiments, at least one of the plurality of side panels is an air vent. In some embodiments, a width of at least one of the side panels in an axial direction is approximately equal to a width of at least one of the roof panels. A length of the at least one of the side panels perpendicular to the axial direction may be different from a length of the at least one of the roof panels.

In some embodiments, at least one of the plurality of frame members may be selected from the group consisting of a hollow tube, a solid rod, a flat plate, an I-channel, a C-channel, or a T-channel.

Another embodiment of the present disclosure relates to a method of assembling a genset enclosure. The method includes providing a frame system including a plurality of interconnected frame members, a first connector coupled to a first end of the plurality of interconnected frame members, and a second connector coupled to a second end of the plurality of interconnected frame members and engageable with the first connector. The method also includes providing a plurality of side panels and a plurality of roof panels. The method includes connecting each of the plurality of roof panels to the roof of the frame system to substantially cover the roof. The frame system, the plurality of side panels, and the plurality of roof panels together define an enclosure portion having a first open end and a second open end.

In some embodiments providing the frame system includes interconnecting opposing ends of each one of the plurality of frame members.

In some embodiments, the method of assembling a genset enclosure also includes assembling the frame system, the plurality of side panels, and the plurality of roof panels together to form a first enclosure segment. The method may further include providing the second enclosure segment and placing the second enclosure segment adjacent to the first open end of the first enclosure segment. The method may also include connecting the second enclosure segment to the first enclosure segment by engaging the second enclosure segment with the first connector.

Another embodiment of the present disclosure relates to a genset enclosure. The genset enclosure includes a main body portion, an air inlet portion, and an air outlet portion. The main body portion includes a plurality of segments that are arranged in series and are connected to one another. The plurality of segments together define an internal volume. Each one of the plurality of segments includes a first frame system including a plurality of interconnected frame members; a side panel coupled to the first frame system; and a roof panel coupled to the first frame system and oriented perpendicular to the side panel. The air inlet portion is coupled to a first end of the main body portion and the air outlet portion is coupled to a second end of the main body portion opposite the first end. The air inlet portion and the air outlet portion each fluidly connect the internal volume to an environment surrounding the genset enclosure.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1:
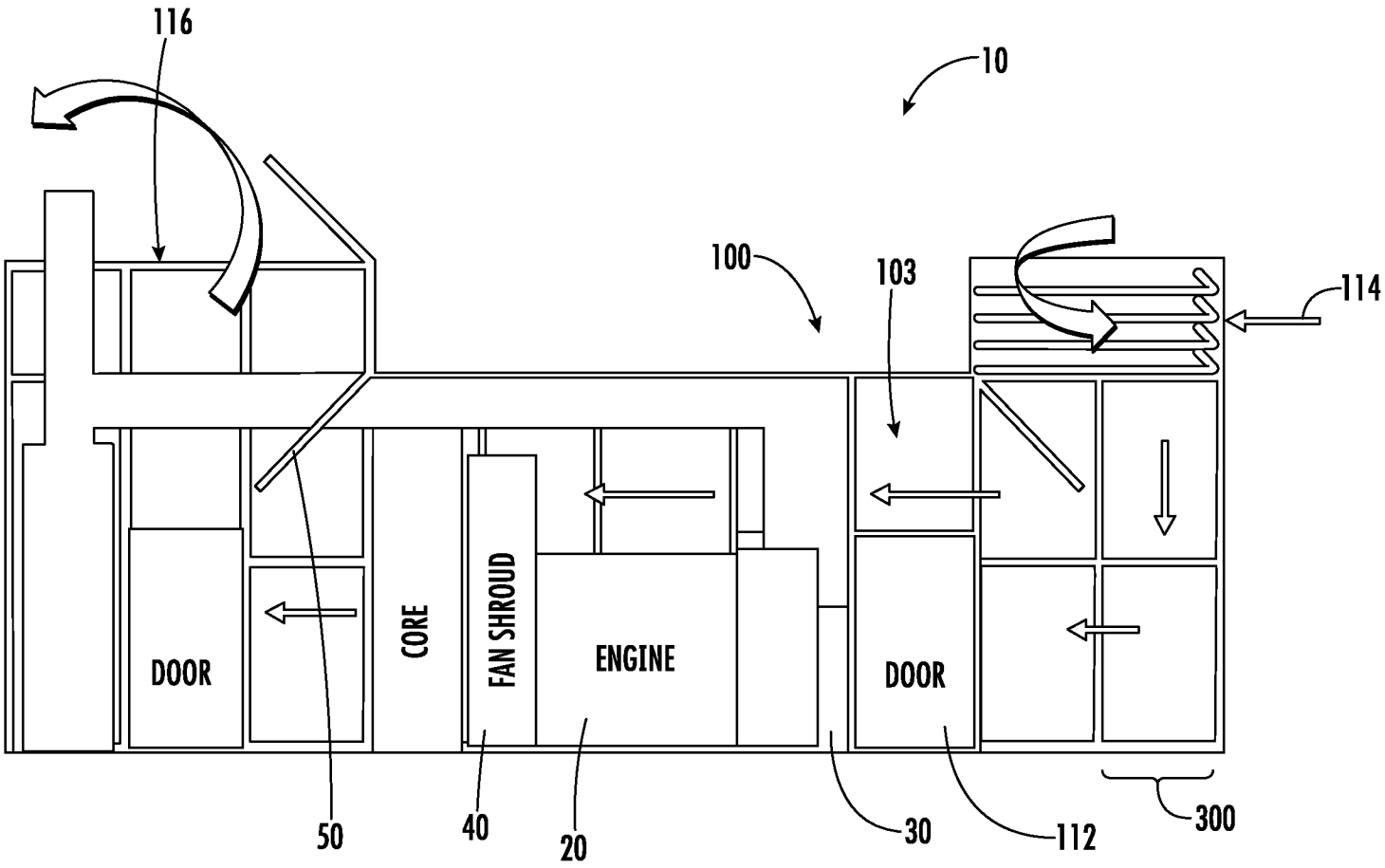
FIG. 1 is a side cross-sectional view of a genset assembly, according to an embodiment.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION

Embodiments described herein relate generally to methods and devices for forming a genset enclosure. In particular, embodiments described herein relate generally to enclosure segments structured to interconnect with one another to form the genset enclosure. Each enclosure segment includes a frame system that includes multiple interconnected frame members. The frame members may be hollow tubular elements or solid rods (or any such elements that can be used as structural frame elements, e.g., the frame elements may be channel frames made of I, C, T channels; a flat solid plate, etc., that are welded or otherwise connected to form a skeleton of the enclosure segment). Frame members on either end of the enclosure segment may include connectors so that multiple enclosure segments can be joined together. Walls of the enclosure segment are formed by panels that are applied to the frame system to enclose the space surrounded by the frame system. Among other benefits, the frame system may be at least partially assembled on site (in the field, at a location where the genset will be installed, etc.). For example, the frame system may be shipped without panels, and the panels, doors, and/or other assembly panels may be applied to the frame system on site to tailor the genset enclosure based to its surroundings (e.g., based on where the enclosure is located, the position of the enclosure in relation to neighboring structures, etc.) and the needs of the end user.

Multiple enclosure segments can be connected in series or otherwise stacked beside and/or above or below one another to form the entire genset enclosure. The size of the genset enclosure may be adjusted by adding or removing segments to accommodate different engine gensets sizes/types and/or auxiliary equipment (e.g., cooling equipment, controls, etc.) within one common enclosure footprint. This construction also provides a compact overall footprint because of the number of sections can be modified as needed to suit the size of the genset. The amount of material required may therefore be less than intermodal container constructions that may be used to house gensets of similar size. Additionally, because of the modular construction of the genset enclosure, the enclosure can be quickly and easily disassembled into sections (e.g., of one or more segments) to transport the enclosure between locations. The genset enclosure is also expandable to accommodate changes to the genset and/or additional auxiliary equipment.

In some embodiments, the enclosure segments and construction techniques are also employed to form the air intake and discharge portions of the enclosure. The various concepts introduced above and discussed in greater detail below may be implemented in any of numerous ways, as the described concepts are not limited to any particular manner of implementation. Examples of specific implementations and applications are provided primarily for illustrative purposes.

Various numerical values herein are provided for reference purposes only. Unless otherwise indicated, all numbers expressing quantities of properties, parameters, conditions, and so forth, used in the specification and claims are to be understood as being modified in all instances by the term "approximately." Accordingly, unless indicated to the contrary, the numerical parameters set forth in the following specification and attached claims are approximations. Any numerical parameter should at least be construed in light of the number reported significant digits and by applying ordinary rounding techniques. The term "approximately" when used before a numerical designation, e.g., a quantity and/or an amount including range, indicates approximations which may vary by (+) or (−) 10%, 5%, or 1%.

As will be understood by one of skill in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member.

FIG. 1 is a side cross-sectional view of a genset assembly 10, according to at least one embodiment. The genset assembly 10 includes an engine 20; a generator 30; an air driver 40; a genset enclosure, shown as enclosure 100; and deflector assemblies 50. The engine 20 may be a diesel engine, a gasoline engine, a natural gas engine, a dual fuel engine, a biodiesel engine, an E85 engine, a flex fuel engine, a gas turbine, or another type of internal combustion engine or driver. In various embodiments, the engine 20 may be a high horse power (HHP) engine, such as, for example, an engine capable of providing power in the range of 500 hp to 4,500 hp or more. The generator 30 may be an electric power generator, an alternator, or the like. In one embodiment, the engine 20 is coupled to the generator 30 by, for example, a driveshaft (not shown). In operation, the engine 20 drives the generator 30 to produce electricity (e.g., power). Embodiments of the present disclosure are also applicable for various types of prime movers (mechanical, electrical, hydro, and/or fuel cell types) with various power strengths (low, medium, and high horse power).

The air driver 40 is structured to draw air (e.g., ventilation air, cooling air, etc.) from an environment surrounding the enclosure 100 through the enclosure 100 to cool the generator 30 and/or other internal components of the genset assembly 10. In at least one embodiment, the air driver 40 is a fan. In other embodiments, the air driver 40 includes a plurality of fans positioned at different locations within the enclosure 100. In some embodiment, the fan may be coupled to the engine 20 (e.g., to the engine driveshaft via a pulley, etc.) such that a speed of the fan is proportional to a speed of the engine 20. In other embodiments, the fan is driven separately from the engine 20 (e.g., via an electric fan motor, etc.).

FIGS. 2-5 shows a perspective, side, front, and bottom views of the enclosure 100, respectively. The enclosure 100 includes end walls 102 (e.g., container walls, sidewalls, etc.) defining an internal volume 103 (e.g., an enclosed space, a hollow region, etc. as shown in FIG. 1) for housing the engine 20, the generator 30, the air driver 40, and other genset components (see also FIG. 1). The end walls 102 include a container floor 104, a container roof 106, a first pair of container sidewalls 108, and a second pair of container sidewalls 110. Each sidewall of the first pair of container sidewalls 108 is disposed at a lateral end of the enclosure 100, while each sidewall of the second pair of container sidewalls 110 is disposed at a longitudinal end of the enclosure 100. The first pair of container sidewalls 108 and the second pair of container sidewalls 110 are arranged in substantially perpendicular orientation relative to the container floor 104 and container roof 106. The container floor 104 and the container roof 106 are coupled at their lateral and longitudinal edges to edges of the container sidewalls 108 (e.g., to upper and lower edges of the container sidewalls 108). At least one door 112 may be provided in at least one of the first plurality of container sidewalls 108 and/or the second pair of container sidewalls 110 to allow access to the genset assembly 10 (e.g., by maintenance or repair personnel). The at least one door 112 allows such personnel to enter the internal volume 103 defined by the enclosure 100 and access the genset. The container floor 104, the container roof 106, the first plurality of container sidewalls 108, and the second pair of container sidewalls 110 together seal the enclosure 100 from the surrounding environment. The container floor 104, container roof 106, the first plurality of container sidewalls 108, and the second plurality of container sidewalls 110 may be formed from any suitable material, for example, carbon or mild steel panels, as will be further described.

In some embodiments, the enclosure 100 may be disposed on the ground. In other embodiments, the enclosure 100 may be mounted on a fuel tank (not shown) that is disposed on the ground, or mounted on skids (not shown) that are disposed on the ground. In other embodiments, the enclosure 100 may be positioned on a rooftop above the ground or another suitable location.

Figure 2:
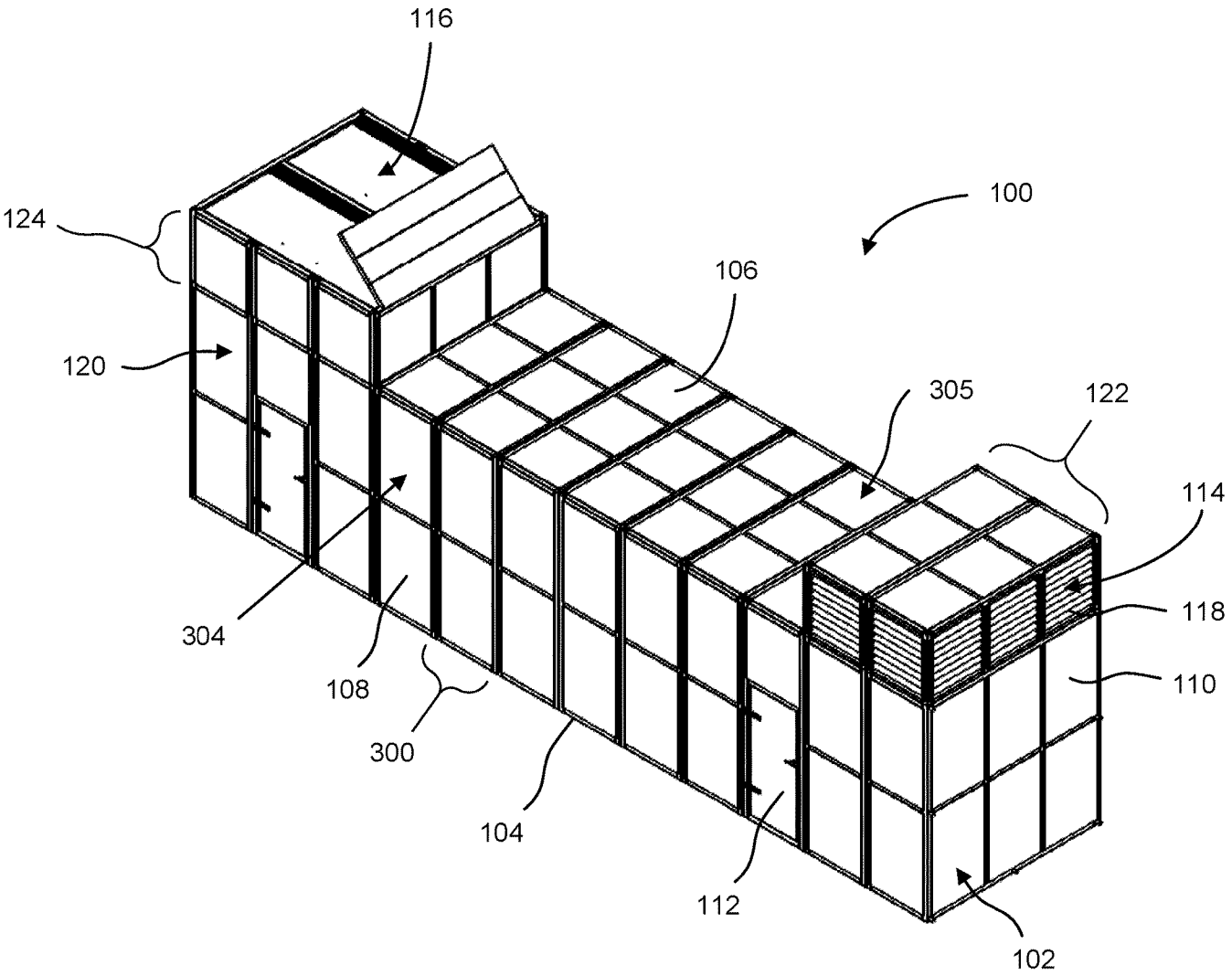
FIG. 2 is a perspective view of a genset enclosure of the genset assembly of FIG. 1.
Figure 4:
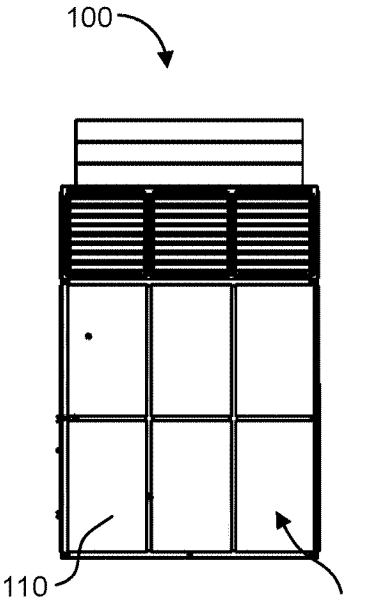
FIG. 4 is a front view of the genset enclosure of FIG. 2.

The enclosure 100 is configured to provide air flow therethrough to cool the genset 10 and provide intake air for the engine of the genset assembly 10. As shown in FIGS. 1-2, the enclosure 100 includes ventilation air openings including a ventilation air intake opening, shown as air inlet 114, and a ventilation air outlet opening, shown as air outlet 116. In at least one embodiment, each of the air inlet 114 and the air outlet 116 are defined in the container roof 106 and fluidly couple the internal volume 103 with an environment surrounding the enclosure 100. In the embodiment of FIGS. 1-2, the air inlet 114 and the air outlet 116 are disposed on opposite ends of the container roof 106. In some embodiments, the air inlet 114 and/or the air outlet 116 may include louvers 118 or other elements that allow air to enter the enclosure 100, while redirecting water (e.g., due to rainfall) away from the enclosure 100 or to predefined water drainage areas of the enclosure 100. In other embodiments, the air inlet 114 and the air outlet 116 may be provided in another location along the enclosure 100 (e.g., the first pair of container sidewalls 108 and/or the second pair of container sidewalls 110).

Figure 6:
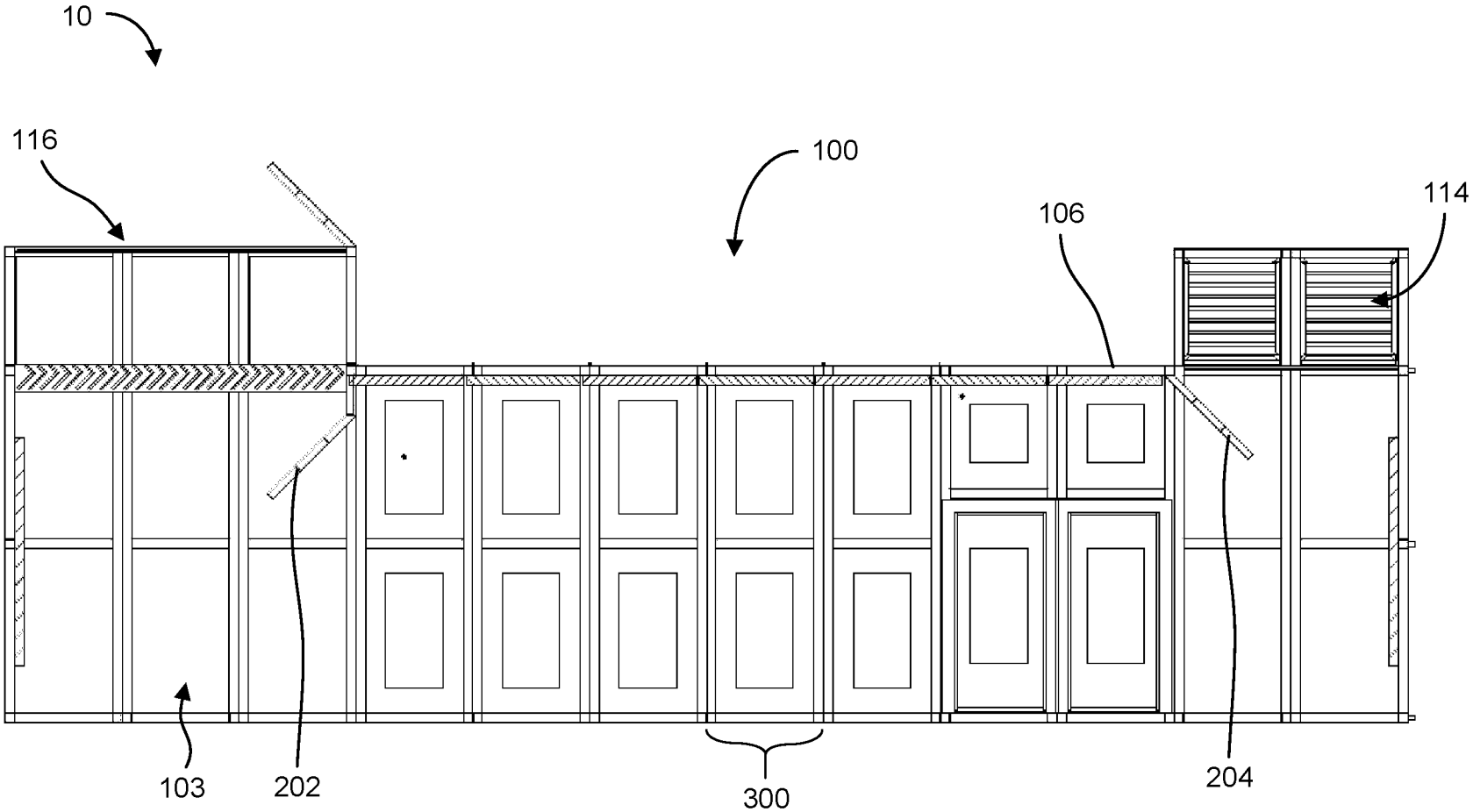
FIG. 6 is a side cross-sectional view of the genset enclosure of FIG. 2.

The genset assembly 10 includes a deflector assembly structured to redirect noise in the air multiple times within the enclosure 100 to attenuate noise exported from the enclosure 100. As shown in FIG. 6, the genset assembly 10 includes two deflector assemblies, including a first deflector assembly 202 and a second deflector assembly 204 disposed on an opposite end of the enclosure 100 as the first deflector assembly 202. The first deflector assembly 202 and the second deflector assembly 204 are mechanically connected to the container roof 106. In the embodiment of FIG. 6, the first deflector assembly 202 is an outlet deflector assembly structured to reflect air proximate to the air outlet 116, while the second deflector assembly 204 is an inlet deflector assembly structure to reflect air proximate to the air inlet 114. In some embodiments, a position (e.g., an angular position, a length, etc.) of the first deflector assembly 202 and the second deflector assembly 204 is adjustable within the enclosure 100 to minimize exported noise. Additional aspects of the structure of the first deflector assembly 202 and the second deflector assembly 204 may be found in U.S.

Patent Application No. 62/944,943, filed Dec. 6, 2019, the entire disclosure of which is hereby incorporated by reference herein.

Figure 3:
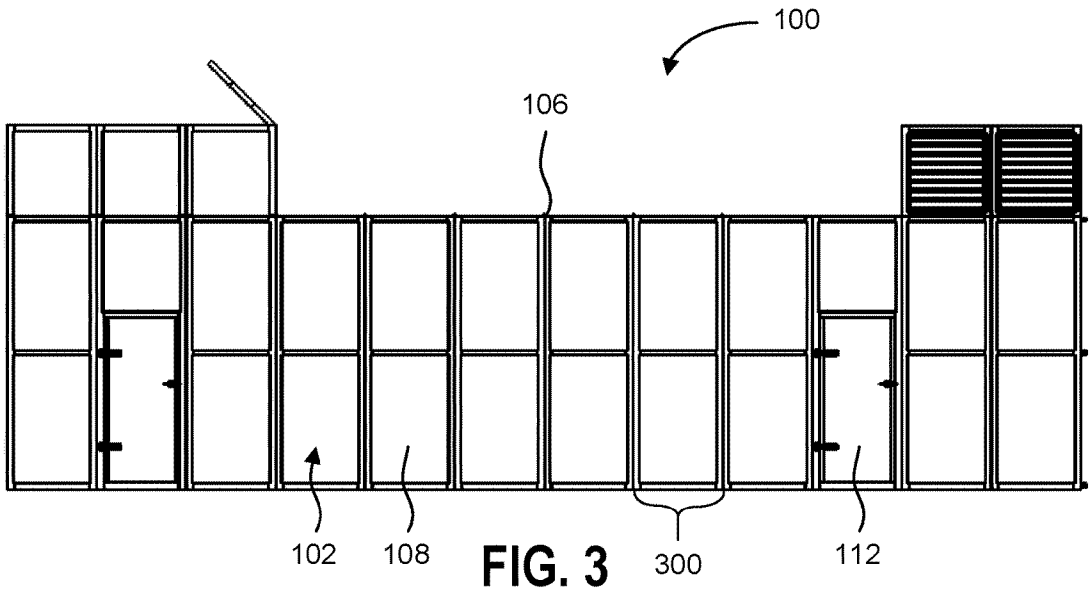
FIG. 3 is a side view of the genset enclosure of FIG. 2.
Figure 5:
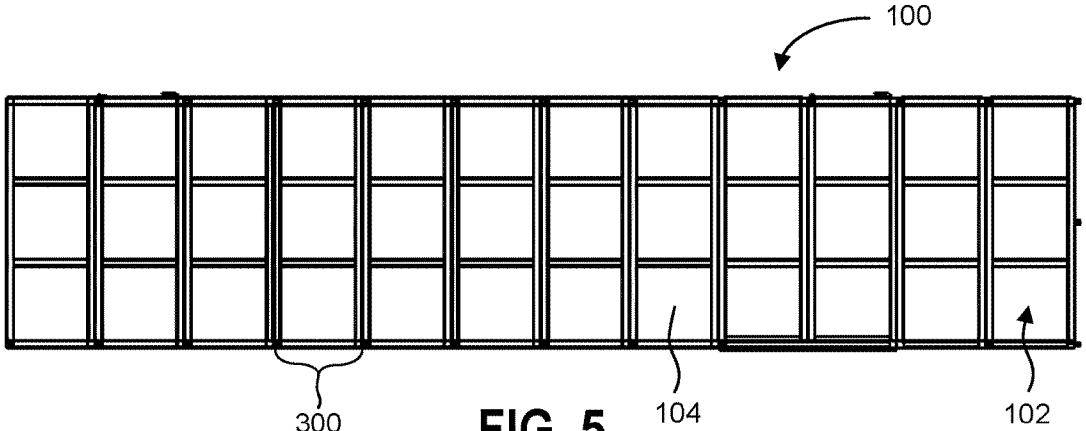
FIG. 5 is a bottom view of the genset enclosure of FIG. 2.

As shown in FIGS. 1-6, the enclosure 100 is formed entirely from a plurality of individual enclosure segments, shown as segments 300. As shown in FIG. 2, the enclosure includes a main body portion 120, an air inlet portion 122, and an air outlet portion 124. In other embodiments, only a portion of the enclosure 100 may be formed from the segments 300 (e.g., only the air inlet portion 122 and the air outlet portion 124, only the main body portion 120 or a sub-portion thereof, etc.). The main body portion 120 is formed by multiple segments 300 that are arranged in series (e.g., end to end, etc.) along an axial direction (e.g., longitudinal direction, substantially parallel to a flow direction through the main body portion 120, etc.). The air inlet portion 122 and the air outlet portion 124 are disposed on the container roof 106, on opposing ends of the container roof 106. A width of each of the air inlet portion 122 and the air outlet portion 124 is approximately the same as a width of the main body portion 120 such that the air inlet portion 122 and the air outlet portion 124 each extend between opposing lateral ends of the container roof 106 (e.g., between the first pair of sidewalls 108 such that the sidewalls of the air inlet portion 122 and the air outlet portion 124 are substantially flush with the first plurality of sidewalls 108). As shown in FIG. 3, a length of the air outlet portion 124 in the axial direction is greater than a length of the air inlet portion 122. In other embodiments, the relative lengths of the air inlet portion 122 and the air outlet portion 124 may be different.

As shown in FIG. 3, the main body portion 120 is formed from 12 individual segments 300. The segments 300 are arranged end-to-end in substantially coaxial arrangement along the axial direction. The segments 300 together form the internal volume 103 of the enclosure 100. The number of segments 300 used to form the enclosure 100 may differ in various embodiments and depending on the size of the generator and/or other components housed within the enclosure 100.

Figure 7:
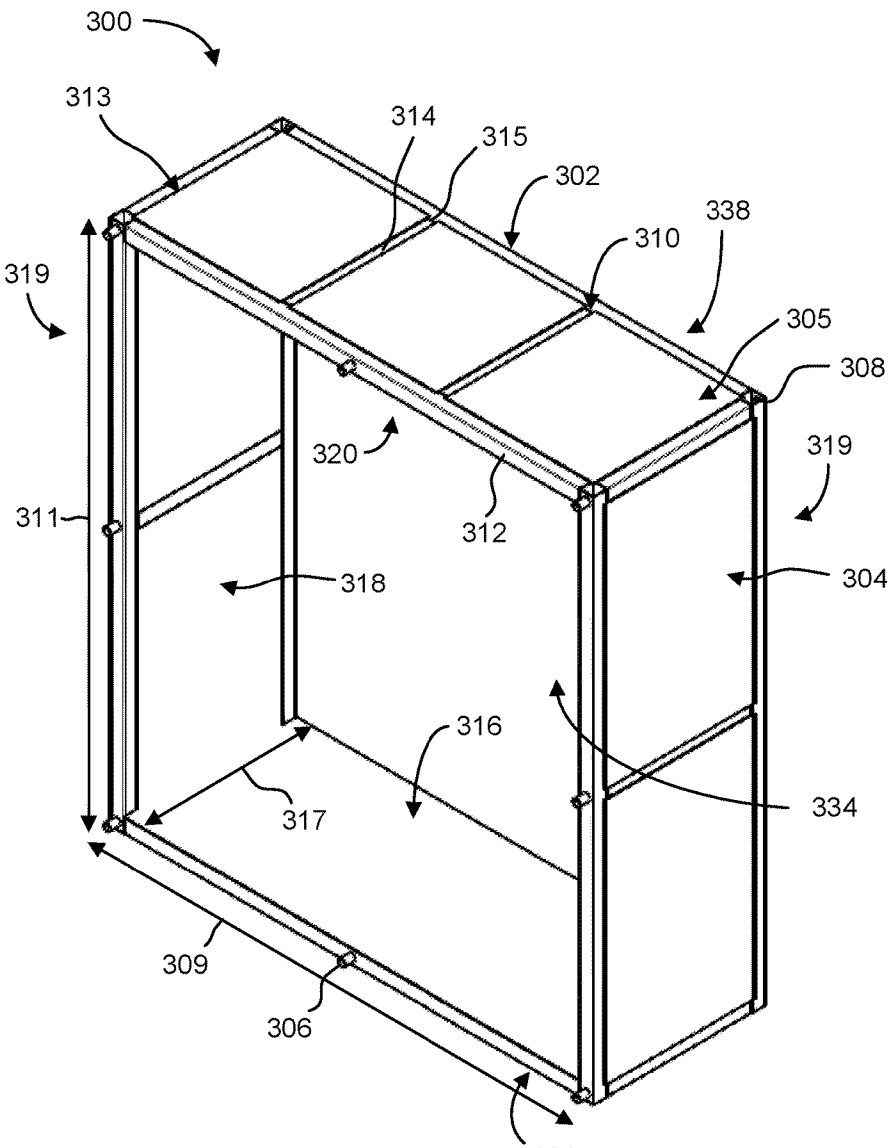
FIG. 7 is perspective view of a segment of the genset enclosure of FIG. 2.

FIG. 7 shows a perspective view of an individual segment 300 of the enclosure 100 (see FIG. 2). The segment 300 forms part of the main body portion 120 of the enclosure 100 (e.g., between doors 112 of the main body portion 120 as shown in FIG. 3). As shown in FIG. 7, the segment 300 includes a frame system 302, a plurality of side panels 304, a plurality of roof panels 305, a first connector 306, and a second connector 308. The frame system 302 forms a skeleton support structure (e.g., space frame, ladder frame, etc.) for the segment 300 to which the other components are connected. The frame system 302 provides structural support for the segment 300 under wind and/or other external structural loading. As shown in FIG. 7, the segment 300 is sized to house a portion of the genset assembly 10 therein (e.g., at least a portion of the engine 20, the generator 30, the air driver 40, etc. as shown in FIG. 1). In the embodiment of FIG. 7, an overall width 309 of the segment 300 may be approximately 9-13 feet, for example. An overall height 311 of the segment 300 may be approximately 10-14 feet, for example, and an overall depth 317 of the segment 300 may be approximately 2-6 feet. In particular, in at least one embodiment, the overall width 309 may be between 2-3 times the overall depth 317. In at least one embodiment, the overall height 311 may be more than 3 times the overall depth 317, for example and may be greater than the overall width 309. It should be appreciated that the foregoing ranges are merely illustrative of representative dimensions and that none of the embodiments are limited to such dimensions or the relative relationships of such dimensions. In other embodiments, the overall dimensions of the segment 300 may be different.

The frame system 302 includes a plurality of interconnected frame members 310 including end members 312 and cross members 314 extending between the end members 312. The end members 312 may be formed of multiple (e.g., four, etc.) frame members 310 that are connected at opposing ends of the frame members 310 to form a rectangular shape. The frame members 310 may be connected via welding, mechanical fasteners, or another suitable joining operation.

The end members 312 are spaced apart from one another in an axial direction and are arranged substantially parallel to one another. The end members 312 are also aligned with one another in substantially coaxial arrangement such that a central axis of a first one of the end members 312 is co-linear with a central axis of a second one of the end members 312. The cross members 314 are engaged with and extend between the end members 312 to form a plurality of openings 313 (e.g., windows, etc.) along the outer perimeter of the frame system 302. The cross members 314 are arranged substantially perpendicular to the end members 312 and are coupled to the end members 312 at opposing ends 315 of the cross members 314. The spacing between the cross members 314 along a perimeter of the end members 312 may differ in various embodiments. In the embodiment of FIG. 7, cross members 314 are positioned at each corner of the rectangular profile formed by the end members 312. Along a floor 316 and sidewalls 318 of the segment 300, a single cross member 314 is disposed at an intermediate position, approximately half way between corners of the rectangular profile. A roof 320 of the segment 300 includes two cross members 314 spaced at approximately equal intervals between the corners of the rectangular profile. In other embodiments, the number and/or arrangement of the cross members 314 and/or end members 312 may be different.

Figure 8:
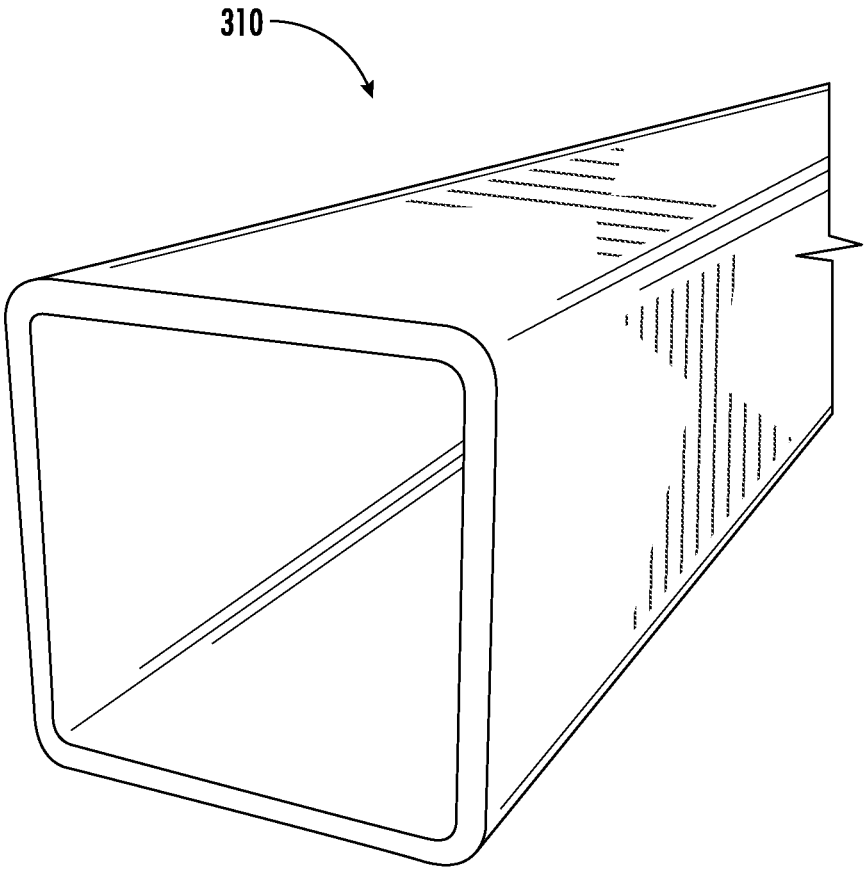
FIG. 8 is a perspective view of a square tubular element used to form the segment of FIG. 7.

The frame members 310 may be made from any suitable structural material. As shown in FIG. 8, each frame member 310 may be a hollow tube of uniform cross-section such as a square/rectangular hollow tube, a circular hollow tube, etc. In other embodiments, the frame members 310 are structural support beams such as an I-channel, C-channel, T-channel, or another suitable channel shape or flat plate, or combinations thereof. In yet other embodiments, the frame members 310 are solid rods (e.g., solid rectangular or circular bar stock, etc.). In yet other embodiments, the frame members 310 are a combination of different structural element types. The frame members 310 may be made from carbon steel tubing (e.g., ASTM A500) or another suitable material. The dimensions of the frame members 310 may differ depending on the overall size of the segment 300. For example, in the embodiment of FIG. 8, the square tubing may be 4 inch×4 inch structural steel tubing, 2 inch×2 inch structural steel tubing, or another suitable size. It should be appreciated that such dimensions are purely exemplary and that the embodiments are not limited to any of such dimensions or ranges thereof.

Figure 10:
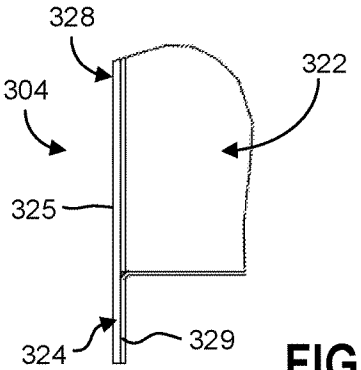
FIG. 10 is a side view of an outer flange of the side panel of FIG. 9.
Figure 9:
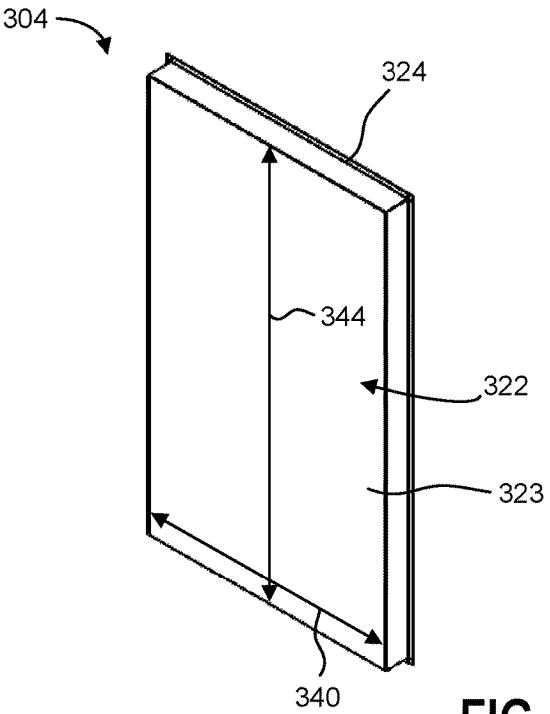
FIG. 9 is a perspective view of a side panel of the segment of FIG. 7.

The side panels 304 form a portion of the first pair of container sidewalls 108 of the enclosure 100 (see FIG. 2). As shown in FIG. 7, the plurality of side panels 304 are coupled to opposing sides 319 (e.g., lateral sides, etc.) of the frame system 302. The side panels 304 are disposed within and substantially cover a respective one of the plurality of openings 313 along the opposing sides 319. As shown in FIGS. 9-10, the side panels 304 are box panels including a main body 322 and a plurality of main body flanges 324 extending outwardly from a perimeter of the main body 322 (e.g., outwardly from the outer four perimeter edges of the main body 322). The main body 322 is a rectangular prism sized to substantially cover a respective one of the plurality of openings 313 (see FIG. 7). The main body 322 includes an inner skin 323 and an outer skin 325. The outer skin 325 is oriented parallel to the inner skin 323 and spaced apart from the inner skin 323 to form an air cavity (e.g., air gap, a hollow interior volume, etc.) therebetween. In the embodiment of FIG. 9, the inner skin 323 and the outer skin 325 are planar sheets of material (e.g., carbon steel, etc.). The outer edges of the inner skin 323 are bent at a 90° angle to form the perimeter walls of the box panel. The outer skin 325 is then welded or otherwise joined with the inner skin 323 to form the box panel. In other embodiments, the perimeter walls of the box panel may be separately formed from the inner skin 323 and the outer skin 325 or at least partially integrally formed with the outer skin 325. In yet other embodiments, at least one of the side panels 304 can be made of single sheet and without an air cavity.

As shown in FIG. 10, the main body flanges 324 are substantially flush with an outward facing surface 328 of the main body 322. Each of the main body flanges 324 is cantilevered from the main body 322 to form a ledge 329 that is engageable with one of the end members 312 and the cross members 314 of the frame system 302 so as to support the main body 322 within the opening 313 (e.g., such that the main body 322 is surrounded by the combination of end members 312 and the cross members 314 as shown in FIG. 7). The main body 322 is sized to fit within the openings 313, which facilitates positioning and alignment of the side panels 304 along opposing sides of the frame system 302. The main body flanges 324 may be welded, mechanically fastened, or otherwise coupled to the frame system 302 to secure the side panels 304 to the frame system 302. In the embodiment of FIGS. 9-10, the main body flanges 324 are formed from the inner skin 323, by bending the outer edges of the inner skin 323 at a 90° angle outwardly from the air cavity and the perimeter wall.

The roof panels 305 form a portion of the container roof 106 of the enclosure 100 (see FIG. 2). As shown in FIG. 7, the plurality of roof panels 305 are coupled to the roof 320 of the frame system 302 and extend laterally between the opposing sides 319 of the frame system 302. The roof panels 305 are oriented perpendicular to the plurality of side panels 304. The roof panels 305 are disposed within and substantially cover the openings 313 along the roof 320 of the frame system 302. As shown in FIG. 10, the design of the roof panels 305 is substantially similar to the design of the side panels 304 (FIGS. 9-10). The roof panels 305 are rectangular-shaped box panels including a main body 330 and a plurality of main body flanges 332 extending outwardly from a perimeter of the main body 330. Each one of the main body flanges 332 is cantilevered from the main body 330 to form a ledge that is engageable with one of the end members 312 and the cross members 314 of the frame system 302 so as to support the main body 330 within the opening 313 (e.g., such that the main body 330 is surround by the combination of end members 312 and the cross members 314 as shown in FIG. 7). The main body 330 is sized to fit within the openings 313, which facilitates positioning and alignment of the roof panels 305 along the roof 320. The main body flanges 332 may be welded, mechanically fastened, or otherwise coupled to the frame system 302 to secure the roof panels 305 to the frame system 302. In some embodiments, the roof panels 305 also form a portion of the container floor 104 of the enclosure 100 (see FIG. 2) and are coupled to the floor 316 of the frame system 302 opposite the roof 320.

As shown in FIG. 7, the frame system 302, the plurality of side panels 304, and the plurality of roof panels 305 together define a portion of the overall enclosure. In FIG. 7, the portion is shown as enclosure portion 334 (e.g., axial portion, etc.) of the internal volume 103 (see also FIGS. 1 and 6). The enclosure portion 334 has a first open end 336 and a second open end 338 that fluidly connect the enclosure portion 334 to the surrounding environment and/or enclosure portions of adjacent enclosure segments.

Figure 11:
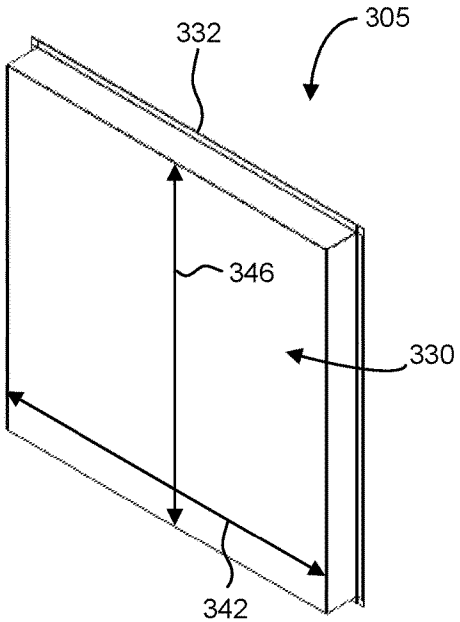
FIG. 11 is a perspective view of a roof panel of the segment of FIG. 7.

As shown in FIG. 7, the size of the side panels 304 is different from the size of the roof panels 305 in a single direction. In particular, as shown in FIGS. 9 and 11, a width 340 of the side panels 304 in an axial direction is approximately equal to a width 342 of the roof panels 305. A length 344 of the side panels 304 in a lateral direction (e.g., perpendicular to the axial direction) is different from a length 346 of the roof panels 305. Among other benefits, the difference in length between the side panels 304 and the roof panels 305 allows for different increments of adjustability in the overall width 348 and overall height 350 of the segment 300 (see FIG. 7). In some embodiments, such a configuration allows for adjustability while ensuring a uniform axial length (e.g., depth) of the segment 300 along the perimeter of the segment 300. The different increments of adjustability may correspond with variations in the length and width of the genset for different genset sizes (e.g., so as to accommodate variations in the length and the width of the genset, which changes as different genset models are employed). In particular, such increments of adjustability serve to minimize the overall footprint of the genset assembly for a given genset size. In other embodiments, the side panels 304 may be approximately the same size as the roof panels 305. In yet other embodiments, the side panels 304 and/or roof panels 305 may each include panels of different sizes.

Figure 12:
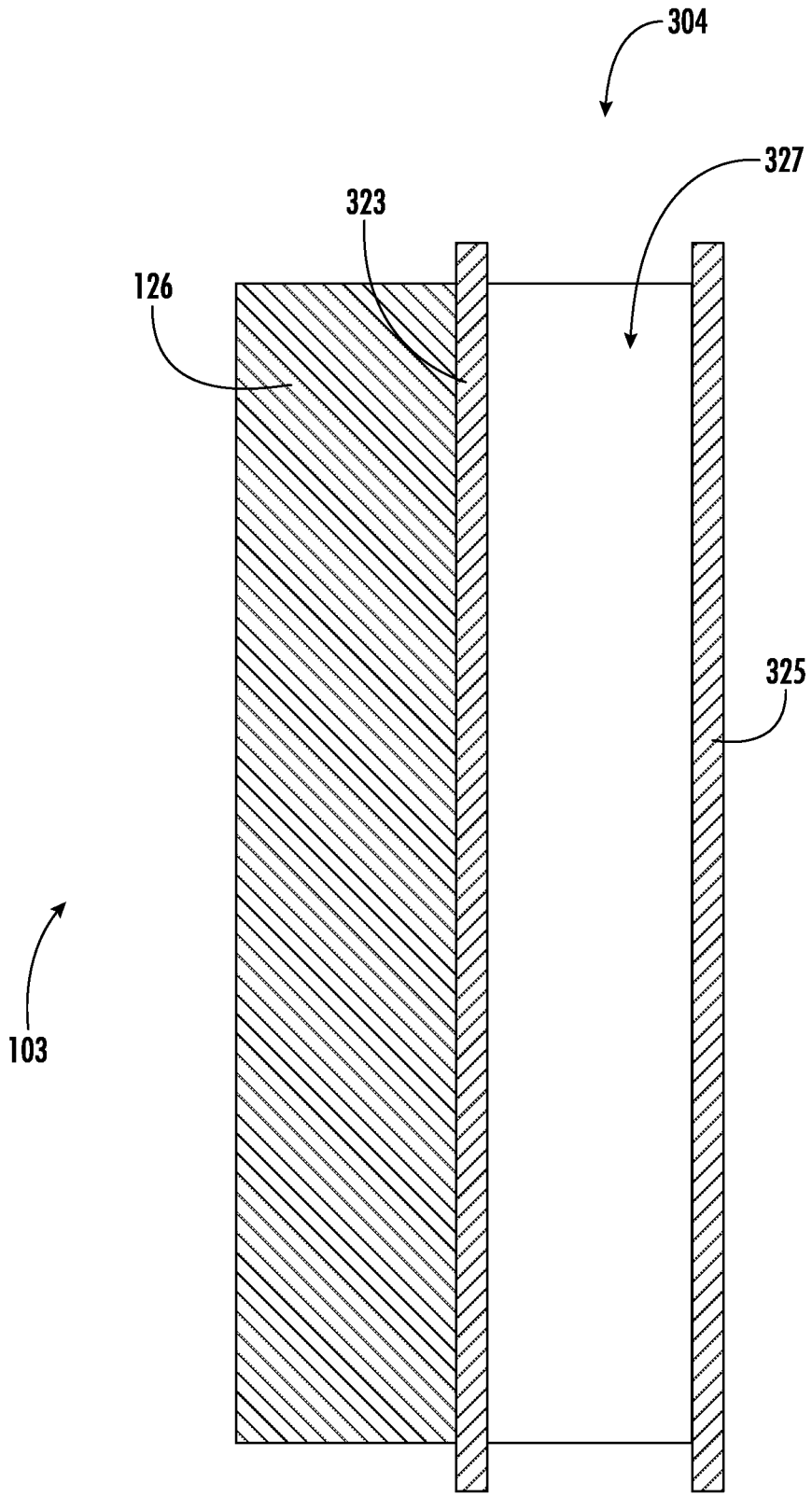
FIG. 12 is a side cross-sectional view of a side panel of FIG. 9 in an installed position.

In various embodiments, inner surfaces of the container floor 104, the container roof 106, the first pair of container sidewalls 108, and the second pair of container sidewalls 110 (see FIG. 1) may be lined with acoustic dampening materials (e.g., acoustic material lining, etc.) structured to absorb and attenuate noise produced by the genset assembly 10. The noise may be generated by internal components such as the engine 20, the generator 30, the fan(s), or the like. Alternatively, or in combination, the noise may be produced as a result of air flow passing through the enclosure 100 via the air inlet 114 and the air outlet 116. FIG. 12 shows a side cross-sectional view through one of the side panels 304 after assembly. As shown, each of the side panels 304 engages the frame system 302 (see FIG. 7) such that the outer skin 325 faces an environment surrounding the enclosure 100 and the inner skin 323 faces the internal volume 103. The inner skin 323 and outer skin 325 may be made from a metal such as carbon or mild steel, or another structurally robust material. In the embodiment of FIG. 12, each side panel 304 is a box panel that includes an air cavity 327 that is "sandwiched" or otherwise disposed between the inner skin 323 and the outer skin 325. Among other benefits, the air cavity 327 may further attenuate noise produced by the genset assembly 10 (see also FIG. 1). An acoustic damping material 126 is mechanically connected (e.g., bonded with an adhesive product, coupled using magnets, coupled using rivets, etc.) to the inner skin 323 within the internal volume 103. In some embodiments, the acoustic damping material 126 completely lines the inner skin 323 along the container end walls 102 (e.g., the side panels 304, the roof panels 305, etc.). In other embodiments, the acoustic damping material 126 includes individual sheets placed along portions of at least one of the end walls 102. For example, the acoustic damping material 126 may be formed in 0.5 ft.×1 ft. sheets, 1 ft.×2 ft. sheets, 2 ft.×4 ft. sheets, 4 ft.×8 ft. sheets, or any other suitable dimensions. In various embodiments, the acoustic damping material 126 may include fibrous (e.g., rock wool, glass wool, mineral wool, etc.), non-fibrous (e.g., polyurethane foam, melamine foam, etc.) materials, or the like.

Figure 13:
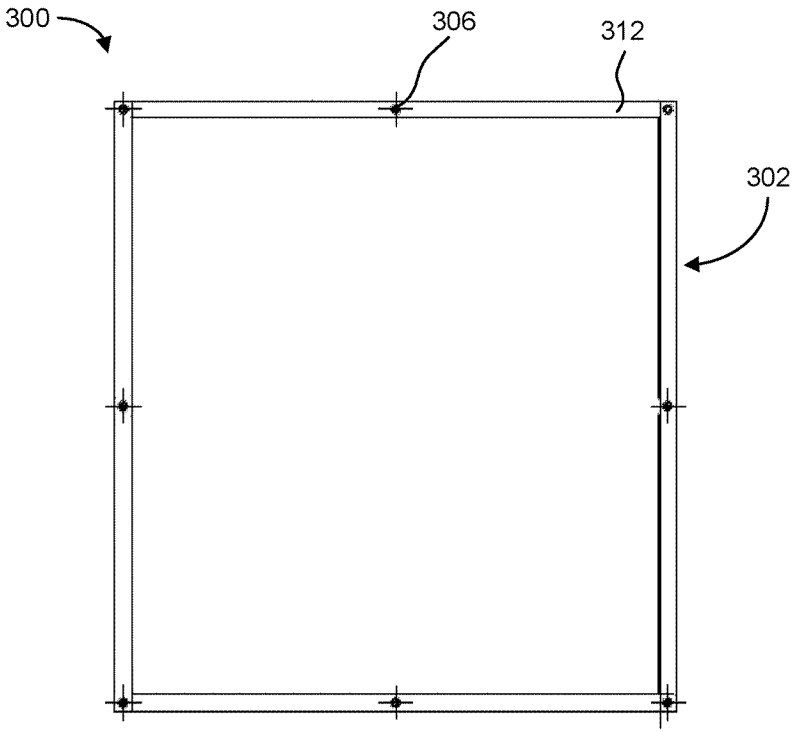
FIG. 13 is a front view of the segment of FIG. 7.
Figure 14:
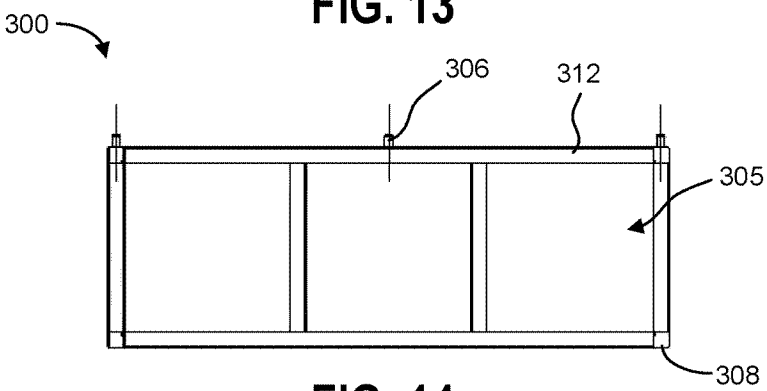
FIG. 14 is a top view of the segment of FIG. 7.

The segment 300 is structured to engage with and couple to other enclosure segments that are placed adjacent to the first open end 336 and the second open end 338 so as to expand the enclosure portion 334 in the axial direction. As shown in FIGS. 13-14, the segment 300 includes a first connector 306 and a second connector 308 structured to facilitate alignment and coupling between adjacent enclosure segments. The first connector 306 is one of a plurality of first connectors 306 coupled to the end member 312 of the frame system 302 along a perimeter of the first open end 336. In the embodiment of FIG. 13, the segment 300 includes eight first connectors 306 that are spaced in approximately equal intervals along the perimeter of the first open end 336. In other embodiments, the segment 300 may include additional or fewer first connectors 306.

The second connector 308 is one of a plurality of second connectors 308 coupled to the end member 312 of the frame system 302 along a perimeter of the second open end 338. Each one of the second connectors 308 is axially aligned with a respective one of the plurality of first connectors 306 such that a central axis of each one of the plurality of second connectors 308 is substantially aligned and collinear with a central axis of a respective one of the plurality of first connectors 306. In other words, the first connectors 306 and the second connectors 308 are arranged in axially aligned pairs along the perimeter of the frame system 302.

Figure 15:
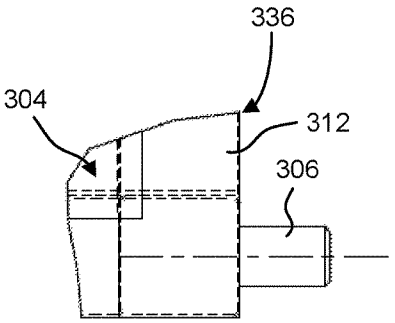
FIG. 15 is a side view of a first connector portion of the segment of FIG. 7.
Figure 16:
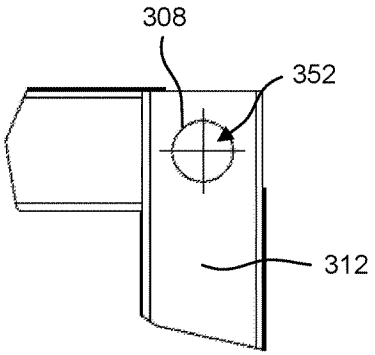
FIG. 16 is side view of a second connector portion of the segment of FIG. 7.

The first connector 306 is engageable with the second connector 308 to align and/or connect adjacent segments 300. As shown in FIG. 15, each of the first connectors 306 is an extension piece that extends axially away from the first open end 336 of the segment 300 (and end member 312). The extension piece may be a cylindrical pin, a bolt (or other threaded connector), a stud, rod, or another suitable extension. In other embodiments, the cross-sectional shape of at least one of the first connectors 306 may be different (e.g., rectangular, oval, etc.). In yet other embodiments, the first connector 306 may another form of male connector, fitting, and/or coupler. As shown in FIG. 16, each of the second connectors 308 is an opening 352 that is sized to receive a first connector 306 therein. The opening 352 is shaped complementary with the first connector 306 (e.g., a circular recess area, etc.) and is sized to substantially prevent movement of adjacent segments 300 normal to the axial direction (e.g., side to side, up and down, etc.). For example, the opening 352 may be sized for slip fit with the first connector 306. In other embodiments, the second connector 308 may be a threaded nut and/or another form of female connector, fitting, and/or coupler. In some embodiments, the first connector 306 and the second connector 308 may be detachably coupled so that adjacent segments 300 can be disassembled for transport and/or repair. In other embodiments, the first connector 306 and the second connector 308 provide alignment and a third connector that is separate from the first connector 306 and the second connector 308 is used to connect the segments 300. In yet other embodiments, the first connectors 306 and/or the second connectors 308 are disposed on other parts of the segment 300 (e.g., other parts of the frame system 302, side panels 304, and/or roof panels 305). In some embodiments, each segment 300 additionally includes a sealing member such as a gasket, weather stripping, or another material to form a watertight seal between adjacent segments 300 and to prevent water ingestion into the internal volume 103 (see FIGS. 1 and 7).

Figure 18:
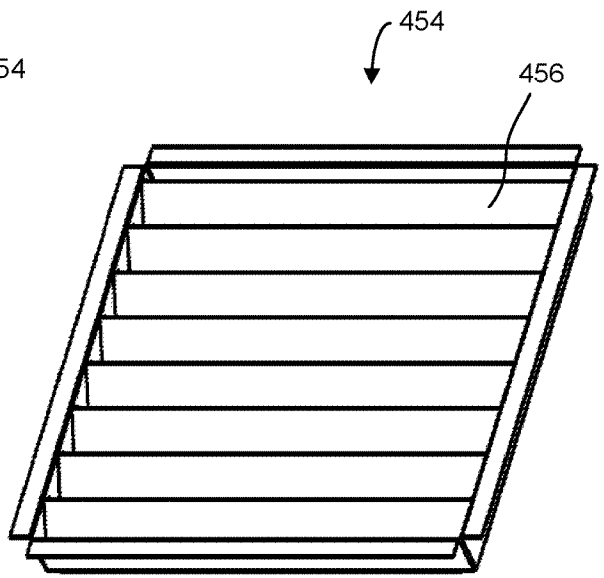
FIG. 18 is a perspective view of an intake vent of the intake assembly of FIG. 17.
Figure 17:
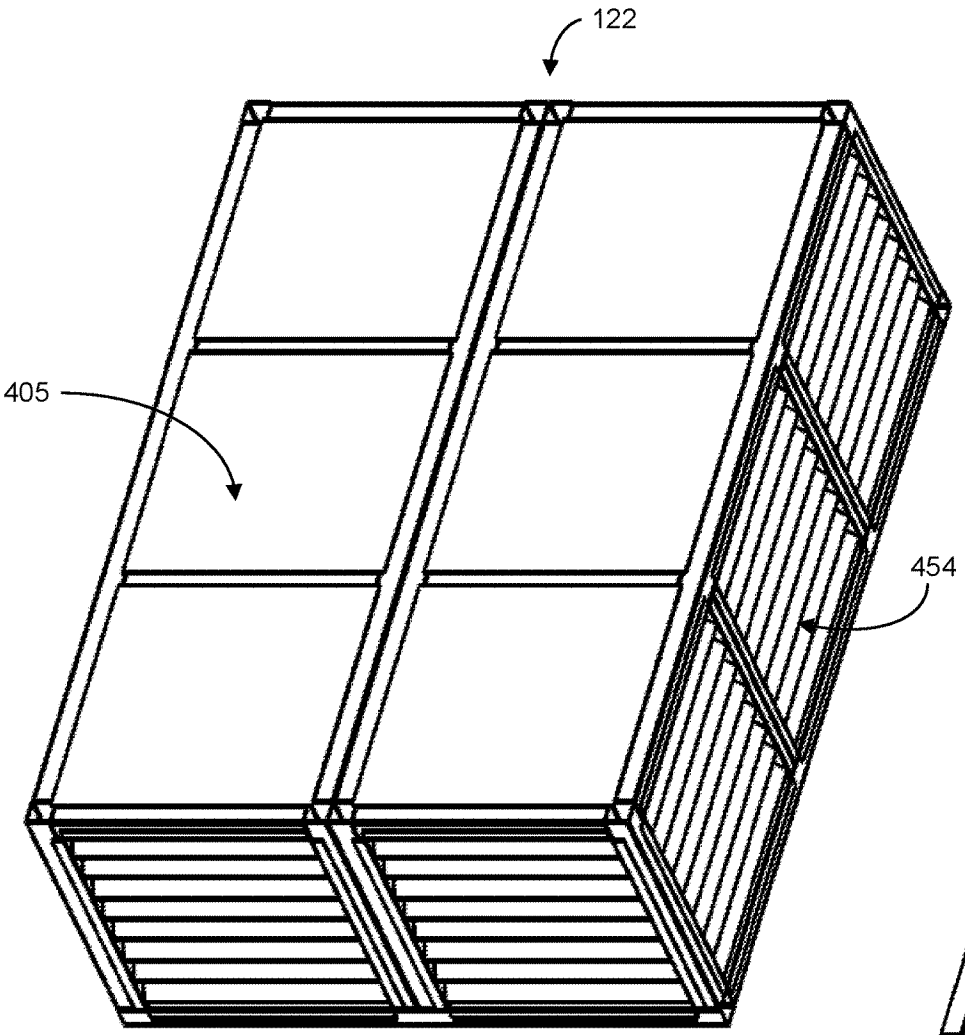
FIG. 17 is a perspective view of an intake assembly of the genset enclosure of FIG. 2.

The arrangement of the frame system 302, side panels 304, and roof panels 305 described with reference to the segment 300 of FIG. 7 is shown for illustrative purposes only. Many alternatives and combinations are possible without departing from the inventive concepts disclosed herein. For example, the construction of the segment 300 may be modified to accommodate a door, air vents, and/or other components of the enclosure 100 by rearranging the position of at least one frame member 310. For example, FIGS. 17-18 show an air inlet portion 122 (e.g., air intake assembly, etc.) of the enclosure 100 of FIGS. 1-2. As shown, the air inlet portion 122 is formed from a plurality of interconnected frame members 410 that are arranged end-to-end to form a skeleton support structure. The air inlet portion 122 also includes a plurality of roof panels 405 engaged with a roof of the support structure and a plurality of air intake vents 454 engaged with sides of the support structure in substantially perpendicular orientation relative to the roof. The roof panels 405 may be the same as or similar to the roof panels 305 described with reference to FIG. 11. As shown in FIG. 18, the air intake vents 454 have a box panel structure as described with reference to FIG. 9, but include a plurality of angled louvers 456 in place of an inner and outer skin (e.g., louvers 456 disposed within an air cavity region of the box panel defined by the perimeter walls of the box panel). The air inlet portion 122 may additionally include at least one first connector and/or second connecter to facilitate alignment between the air inlet portion 122 and other segments 300 of the enclosure 100 (see FIG. 2).

Figure 19:
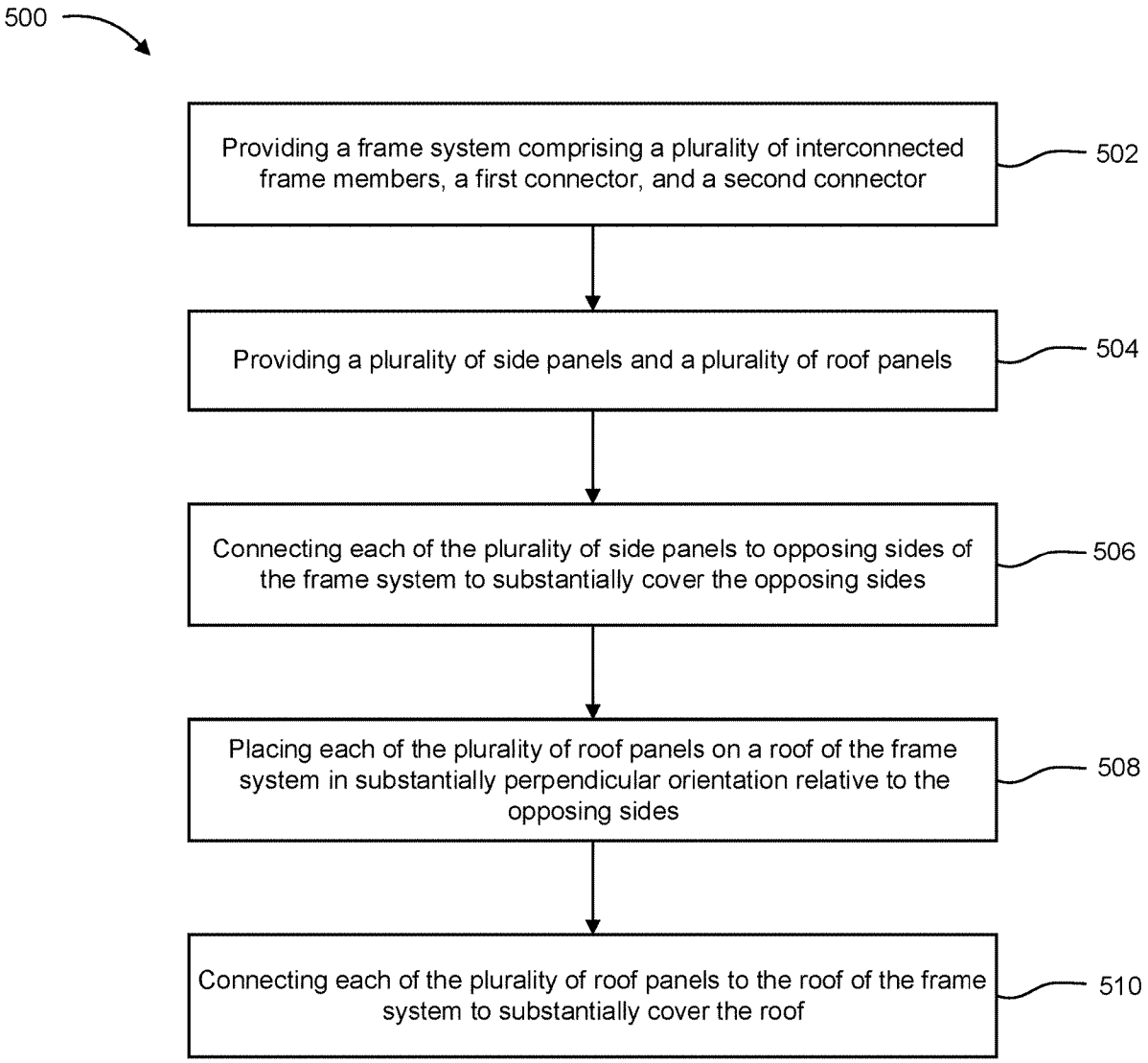
FIG. 19 is a flow diagram of a method of making a genset enclosure, according to an embodiment.

Referring now to FIG. 19, a method 500 of making a genset enclosure is shown, according to an embodiment. The enclosure may be the same as or similar to the enclosure 100 described with reference to FIGS. 1-2 and/or the enclosure segment described with reference to FIG. 7. As such, similar numbering will be used to identify similar components.

At 502, a frame system (e.g., frame system 302) is provided. Operation 502 may include providing a plurality of interconnected frame members (e.g., frame members 310) and interconnecting (e.g., welding, fastening, etc.) opposing ends of each one of the plurality of frame members. Operation 502 may also include providing connectors (e.g., first connectors 306 and second connectors 308) and placing the connectors on opposing ends of the frame system. Operation 502 may additionally include joining the connectors with at least one frame member (e.g., via welding, fastening, or another suitable joining operation).

At 504, a plurality of side panels (e.g., side panels 304) and a plurality of roof panels (e.g., roof panels 305) are provided. In other embodiments, operation 504 may include providing a single side panel and a single roof panel. At 506, each of the plurality of side panels is connected to one of two opposing sides of the frame system to substantially cover the opposing sides. Operation 506 may include aligning each side panel with a respective one of the openings (e.g., openings 313) in the frame system along one of the opposing sides and engaging the side panel with a respective one of the openings (e.g., by pressing the side panel at least partially into the opening). Operation 506 may further include welding, fastening, or otherwise coupling at least one main body flange (e.g., main body flange 324) of the side panel to the frame members.

At 508, each of the plurality of roof panels are placed onto a roof of the frame system in substantially perpendicular orientation relative to the opposing sides of the frame system and side panels. Operation 508 may include aligning each roof panel with a respective one of the windows of the frame system along the roof and engaging the roof panel with a respective one of the openings (e.g., by pressing the roof panel at least partially into the opening). At 510, each of the plurality of roof panels is connected to the roof of the frame system to substantially cover the roof. Operation 510 may include welding, fastening, or otherwise coupling at least one main body flange (e.g., main body flange 332) of the roof panel to the frame members. Operations 502 through 510 may form a first enclosure segment of the genset enclosure.

In some embodiments, the method 500 further includes joining multiple segments (e.g., segments 300) to expand the internal volume (e.g., internal volume 103) circumscribed (e.g., encompassed, etc.) by the enclosure along an axial direction. The method 500 may include providing a second enclosure segment and placing the second enclosure segment adjacent to the first open end of the first enclosure segment. The method 500 may include axially aligning the first enclosure segment with the second enclosure segment (e.g., aligning the first connector of the first enclosure segment with the second connector of the second enclosure segment). The method 500 may further include connecting the second enclosure segment to the first enclosure segment; for example, by engaging the first connector of the first enclosure segment with the second connector of the second enclosure segment (e.g., by moving the second enclosure segment axially toward the first enclosure segment). In other embodiments, the method 500 may include additional, fewer, and/or different operations.

It should be noted that the term "example" as used herein to describe various embodiments is intended to indicate that such embodiments are possible examples, representations, and/or illustrations of possible embodiments (and such term is not intended to connote that such embodiments are necessarily extraordinary or superlative examples).

As utilized herein, the term "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed (e.g., within plus or minus five percent of a given angle or other value) are considered to be within the scope of the invention as recited in the appended claims.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Other substitutions, modifications, changes and omissions may also be made in the design, operating conditions and arrangement of the various exemplary embodiments without departing from the scope of the embodiments described herein.

While this specification contains many specific implementation details, these should not be construed as limitations on the scope of any embodiment or of what may be claimed, but rather as descriptions of features specific to particular implementations of particular embodiments. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A genset enclosure, comprising:

a frame system comprising a plurality of interconnected frame members;

a plurality of side panels coupled to opposing sides of the frame system;

a plurality of roof panels coupled to a roof of the frame system and extending between the opposing sides of the frame system, the plurality of roof panels oriented perpendicular to the plurality of side panels, the frame system, the plurality of side panels, and the plurality of roof panels together defining an enclosure portion having a first open end and a second open end;

a first connector coupled to the frame system along a perimeter of the first open end; and a second connector coupled to the frame system along a perimeter of the second open end, the second connector engageable with the first connector.

2. The genset enclosure of claim 1, wherein the frame system, the plurality of side panels, and the plurality of roof panels together form a first enclosure segment, and wherein the genset enclosure further comprises a second enclosure segment coupled to the first enclosure segment and engaged with the first connector, the second enclosure segment extending along an axial direction of the enclosure portion.

3. The genset enclosure of claim 1, wherein the first connector is one of a plurality of first connectors disposed along the perimeter of the first open end and the second connector is one of a plurality of second connectors disposed along the perimeter of the second open end, and wherein each of the plurality of second connectors is axially aligned with a respective one of the plurality of first connectors.

4. The genset enclosure of claim 1, wherein the first connector comprises a pin extending axially away from the first open end, and wherein the second connector includes an opening dimensioned to receive the pin therein.

5. The genset enclosure of claim 1, wherein at least one of the plurality of side panels is an air vent.

6. The genset enclosure of claim 1, wherein a width of at least one of the side panels in an axial direction is approximately equal to a width of at least one of the roof panels, and wherein a length of the at least one of the side panels perpendicular to the axial direction is different from a length of the at least one of the roof panels.

7. The genset enclosure of claim 1, wherein at least one of the plurality of frame members is selected from the group consisting of a hollow tube, a solid rod, a flat plate, an I-channel, a C-channel, or a T-channel.

8. A method of assembling a genset enclosure, comprising:

providing a frame system, comprising:

a plurality of interconnected frame members;

a first connector coupled to a first end of the plurality of interconnected frame members; and a second connector coupled to a second end of the plurality of interconnected frame members and engageable with the first connector;

providing a plurality of side panels and a plurality of roof panels;

connecting the plurality of side panels to opposing sides of the frame system to substantially cover the opposing sides of the frame system;

placing each of the plurality of roof panels on a roof of the frame system in substantially perpendicular orientation relative to the opposing sides; and connecting each of the plurality of roof panels to the roof of the frame system to substantially cover the roof, the frame system, the plurality of side panels, and the plurality of roof panels together defining an enclosure portion having a first open end and a second open end.

9. The method of claim 8, wherein providing the frame system comprises interconnecting opposing ends of each one of the plurality of frame members.

10. The method of claim 8, further comprising:

assembling the frame system, the plurality of side panels, and the plurality of roof panels together to form a first enclosure segment;

providing a second enclosure segment;

placing the second enclosure segment adjacent to the first open end of the first enclosure segment; and connecting the second enclosure segment to the first enclosure segment by engaging the second enclosure segment with the first connector.

11. The method of claim 8, wherein the first connector is one of a plurality of first connectors disposed along the perimeter of the first open end and the second connector is one of a plurality of second connectors disposed along the perimeter of the second open end, and wherein each of the plurality of second connectors is axially aligned with a respective one of the plurality of first connectors.

12. The method of claim 8, wherein the first connector comprises an extension piece extending axially away from the first open end, and wherein the second connector includes an opening dimensioned to receive the extension piece therein.

13. The method of claim 8, wherein at least one of the plurality of side panels is an air vent.

14. The method of claim 8, wherein a width of at least one of the side panels in an axial direction is approximately equal to a width of at least one of the roof panels, and wherein a length of the at least one of the side panels perpendicular to the axial direction is different from a length of the at least one of the roof panels.

15. The method of claim 8, wherein at least one of the plurality of frame members is selected from the group consisting of a hollow tube, a solid rod, a flat plate, an I-channel, a C-channel, or a T-channel.

16. A genset enclosure, comprising:

a main body portion comprising a plurality of segments, the plurality of segments arranged in series and connected to one another, the plurality of segments together defining an internal volume, each of the plurality of segments comprising:

a first frame system comprising a first plurality of interconnected frame members;

a side panel coupled to the first frame system; and a roof panel coupled to the first frame system and oriented perpendicular to the side panel;

an air inlet portion coupled to a first end of the main body portion; and an air outlet portion coupled to a second end of the main body portion opposite the first end, the air inlet portion and the air outlet portion each fluidly connecting the internal volume to an environment surrounding the genset enclosure.

17. The genset enclosure of claim 16, wherein each segment further comprises a first connector and a second connector coupled to opposing ends of the first frame system and engaged with adjacent ones of the plurality of segments.

18. The genset enclosure of claim 17, wherein the first connector is one of a plurality of first connectors and the second connector is one of a plurality of second connectors, and wherein each of the plurality of second connectors is axially aligned with a respective one of the plurality of first connectors.

19. The genset enclosure of claim 16, wherein at least one of the first plurality of interconnected frame members is selected from the group consisting of a hollow tube, a solid rod, a flat plate, an I-channel, a C-channel, or a T-channel.

20. The genset enclosure of claim 16, wherein at least one of the air inlet portion or the air outlet portion comprises:

an air vent coupled to a second frame system comprising a second plurality of interconnected frame members.

* * * * *